United States Patent [19]

Bonde

[11] Patent Number: 4,926,814

[45] Date of Patent: May 22, 1990

[54] CRANKCASE BREATHER AND LUBRICATION OIL SYSTEM FOR AN INTERNAL COMBUSTION ENGINE

[75] Inventor: Kevin G. Bonde, Kiel, Wis.

[73] Assignee: Tecumseh Products Company, Tecumseh, Mich.

[21] Appl. No.: 378,867

[22] Filed: Jul. 12, 1989

[51] Int. Cl.[5] ..... F01M 1/00

[52] U.S. Cl. ..... 123/196 W; 123/41.86; 184/6.18

[58] Field of Search ..... 123/41.86, 196 W, 196 CP

[56] References Cited

U.S. PATENT DOCUMENTS

| | | | |
|---|---|---|---|
| 2,607,332 | 8/1952 | Bosma | 123/196 W |
| 3,096,850 | 7/1963 | Rosenqvist | 184/6.18 |
| 3,195,526 | 7/1965 | Jordan | 123/73 AD |
| 4,470,389 | 9/1984 | Mitadera et al. | 123/196 CP |
| 4,549,520 | 10/1985 | Tamba et al. | 123/572 |
| 4,688,529 | 8/1987 | Mitadera et al. | 123/196 CP |
| 4,727,834 | 3/1988 | Isaka et al. | 123/196 W |

FOREIGN PATENT DOCUMENTS

| | | | |
|---|---|---|---|
| 241662 | 11/1962 | Australia | 123/196 W |
| 56-41056 | of 1981 | Japan . | |

*Primary Examiner*—E. Rollins Cross

*Attorney, Agent, or Firm*—Jeffers, Hoffman & Niewyk

[57] ABSTRACT

An internal combustion engine having a vertically oriented crankshaft and a horizontally oriented cylinder bore and including a plurality of lubrication sites to be pressure lubricated. A first upstanding wall extends upwardly from the top wall of the crankcase and circumscribes and defines a first chamber. A breather passage communicates crankcase gases from the crankcase into the first chamber. A drain passage communicates oil separated from the crankcase gases in the first chamber into the cylinder bore below the piston and is positioned along the cylinder bore so as to be periodically occluded by the piston during reciprocation thereof. A second upstanding wall extends upwardly from the top wall of the crankcase in spaced relationship to at least a portion of the first wall, and defined together with the first wall a second chamber therebetween. A first oil passage communicates oil from a lubricant pump to the second chamber, and a second oil passage communicates oil from the second chamber to at least one of the lubrication sites.

16 Claims, 3 Drawing Sheets

CRANKCASE BREATHER AND LUBRICATION OIL SYSTEM FOR AN INTERNAL COMBUSTION ENGINE

BACKGROUND OF THE INVENTION

The present invention generally relates to an internal combustion engine of the type having a vertical crankshaft, and more particularly to such an engine having a breather chamber for venting of crankcase gases and separating and recovering lubrication oil from the gases, and further having a pressure lubrication system having multiple oil passageways.

Air-cooled internal combustion engines sometimes have a crankcase breather system for venting blow-by gases which get by the piston rings and valve sem seals and enter the crankcase. The breather system insures that excessive pressure does not develop in the crankcase. Such a breather system ofen involves a check valve which allows gases to exit the crankcase but not to enter. It is a phenomenon of such systems that lubricating oil mist generated in the crankcase is carried along with the vented gases which exit through the check valve and it is desireable to separate out such oil and drain it back into the crankcase. The breather check valve, separator chamber and oil drain in the past have been located in a variety of positions relative to the crankcase.

An engine of the type involved herein is also sometimes provided with a pressure lubrication system involving an oil pump and various oil distribution passageways to convey the oil from the pump to the various lubrication sites within the engine where the oil is needed. In the past, pressurized lubrication of upper bearings in vertical shaft engines has been accomplished by drilling long cross-drilled passages and interconnecting holes and plugging the ends to form lubrication passages. The relatively large amount of machining involved in drilling and plugging passages increases the cost of manufacture.

It would be desirable to provide a vertical shaft engine with a crankcase breather system and a pressure lubrication system which simplifies and reduces machining and reduces the cost of manufacture of the engine. This and other desirable features are achieved by the present invention.

SUMMARY OF THE INVENTION

The present invention involves providing a vertical shaft internal combustion engine with a breather chamber and a lubrication chamber which are for the most part formed by upstanding walls on the top of the crankcase so that the horizontal reaches of the chambers are formed primarily by casting, and drilling of passages is limited primarily to the generally vertical reaches and for precise delivery to the lubrication site. In a preferred embodiment, the breather chamber and lubrication chamber are formed adjacent one another and share a common upstanding wall. The upstanding walls are finished to a common height so that both the breather chamber and the lubrication chamber are closed at the top by a single planar cover.

Long cross-drilled passages for lubrication of the upper bearings have been substantially eliminated by the present invention since the horizontal extensions of the passages have been replaced by a cast chamber which is curved as necessary to traverse obstructions.

Only short straight drilled passages extend from the cast lubrication chamber to the lubrication sites.

A breather system involving a check valve, separation chamber, and oil drain back passage is obtained in an economical manner through strategic location on the top of the crankcase where it is integrated with the lubrication chamber so that thee is a sharing of defining structure and the cover.

The oil drain passage of the breather system is located so as to be ported by the piston as it reciprocates, thereby occluding the drain passage on the downstroke of the piston, and uncovering it on the upstroke. In this way escape of crankcase gases through the oil drain back hole is avoided and oil drains back into the crankcase through the drain back passage. An advantage of this arrangement is that air pressurized in the crankcase on the downstroke of the piston does not blow through the drainn hole and re-suspend the separated oil in the breather chamber. In addition, the entire cycle of the engine is available for the collection of oil, rather than only one half of the cycle in the case where the drain passage is not ported by the piston.

It is an advantage of the arrangement of the lubrication chamber that oil can be transported about the top of the crankcase from a convenient oil riser such as the camshaft to whatever lubrication site requires pressure lubrication without requiring the drilling and plugging of multiple cross passageways. The lubrication chamber forms a sort of oil bus which can be tapped into by drilling a single straight passage through the bottom of the chamber to the lubrication site. Adding options that require direct lubrication, such as a counterbalance shaft, simply requires an additional drilled passage. Consequently, the cost of manufacturing the engine is significantly reduced. A further reduction in cost of manufacture is obtained from the structural relationship between the lubrication system and the breather chamber, i.e. shared walls and cover, as discussed above.

The invention, in accordance with one embodiment thereof, involves an internal combustion engine including a crankcase having a generally horizontal oriented top wall, an oil sump, an oil pump, and a vertically oriented crankshaft rotatably journalled therein. A horizontally oriented cylinder bore communicates with and extends from the crankcase, and a piston is disposed for reciprocation within the cylinder bore and is linked to the crankshaft. The engine includes a plurality of lubrication sites to be pressure lubricated. A first upstanding wall extends upwardly from the top wall of the crankcase and circumscribes and defines a first chamber. A breather passage means is provided for communicating crankcase gases from the crankcase into the first chamber. A drain passage means is also provided for communicating oil separated from the crankcase gases in the first chamber into the cylinder bore below the piston, the drain passage means being positioned along the cylinder bore so as to be periodically occluded by the piston during reciprocation thereof. A second upstanding wall extends upwardly from the top wall of the crankcase in spaced relationship to at least a portion of the first wall, the first and second walls defining therebetween a second chamber. Included is a first oil passage means communicating oil from the lubricant pump to the second chamber, and a second oil passage means communicating oil from the second chamber to at least one of the lubrication sites.

DESCRIPTION OF THE PREFERRED EMBODIMENT

Figure 1:
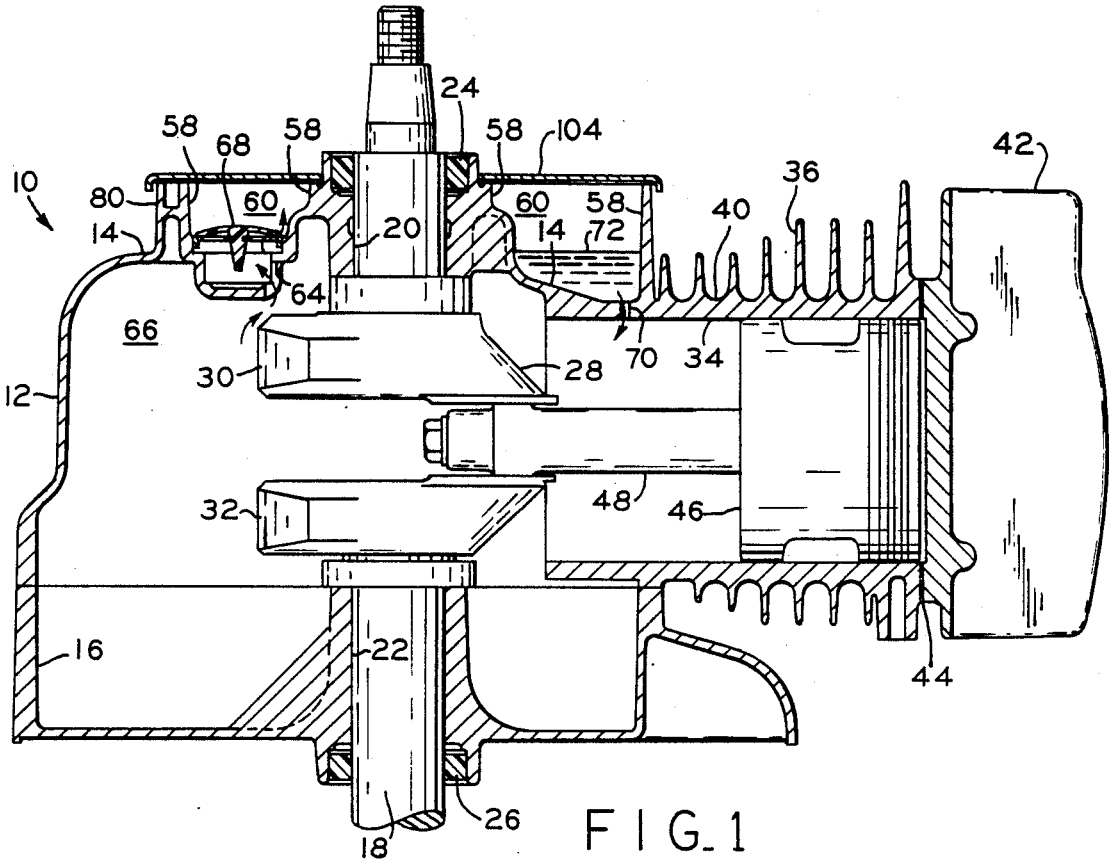
FIG. 1 is an elevational cross-sectional view of an internal combustion engine in accordance with a preferred embodiment of the present invention, taken along section line 1—1 of FIG. 4 and viewed in the direction of the arrows.
Figure 2:
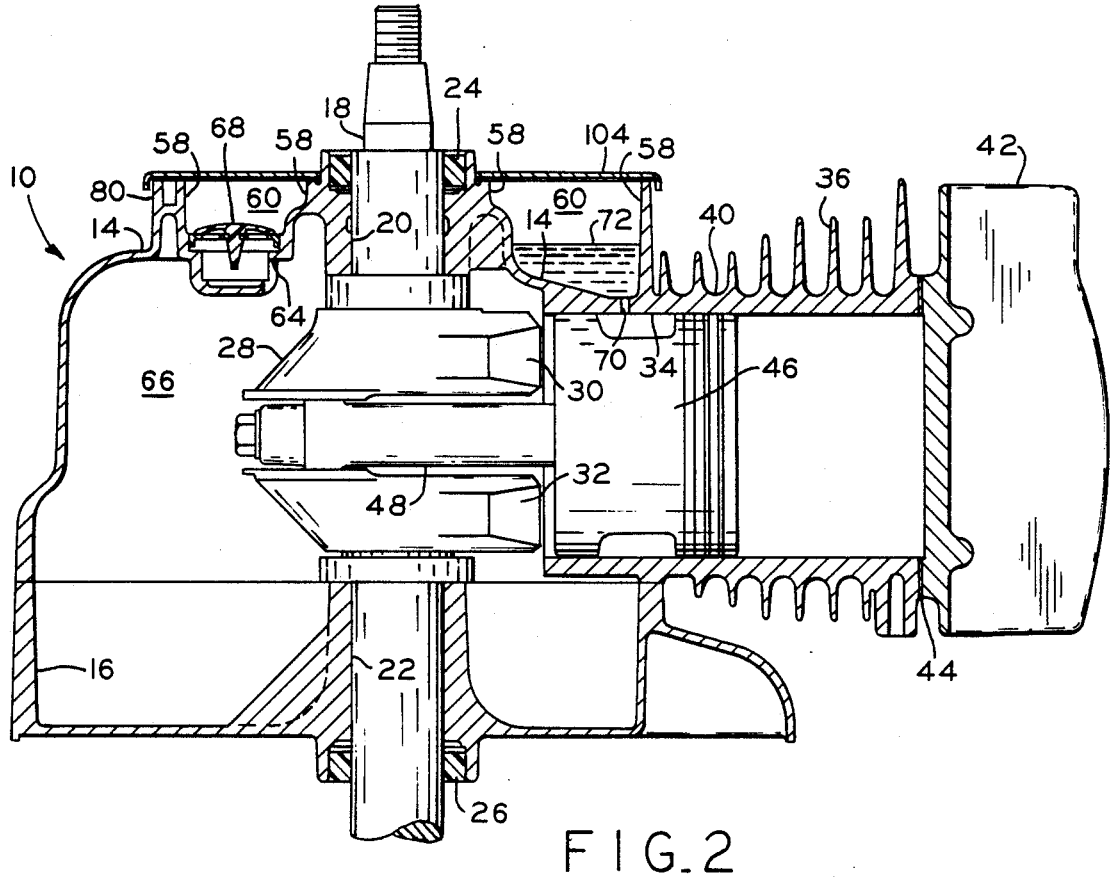
FIG. 2 is an elevational cross-sectional view of the engine of FIG. 1 taken along the same section line as FIG. 1 but showing the piston and crankshaft displaced.

Referring to the figures, there is illustrated an internal combustion engine 10 in accordance with the present invention. Engine 10 includes a crankcase 12 having a generally horizontal top wall 14, an oil sump 16, and a vertically oriented crankshaft 18 journalled for rotation therein at bearing journals 20 and 22. A top seal 24 and a bottom seal 26 provide sealing of crankshaft 18 with respect to crankcase 12 to prevent migration of oil therepast. Crankshaft 18 includes a crank 28 and counterweights 30 and 32. Horizontally oriented cylinder bore 34 communicates with crankcase 12 and extends therefrom. Cooling fins 36 on the outside of cylinder 40 provide for dissipation of heat. Cylinder head 42 is attached to the top of cylinder 40 and sealed thereto by gasket 44, thereby closing the top of cylinder bore 34. Received within cylinder bore 34 is piston 46 arranged for reciprocation therein. Piston 46 is linked to crank 28 of crankshaft 18 by connecting rod 48.

Figure 3:
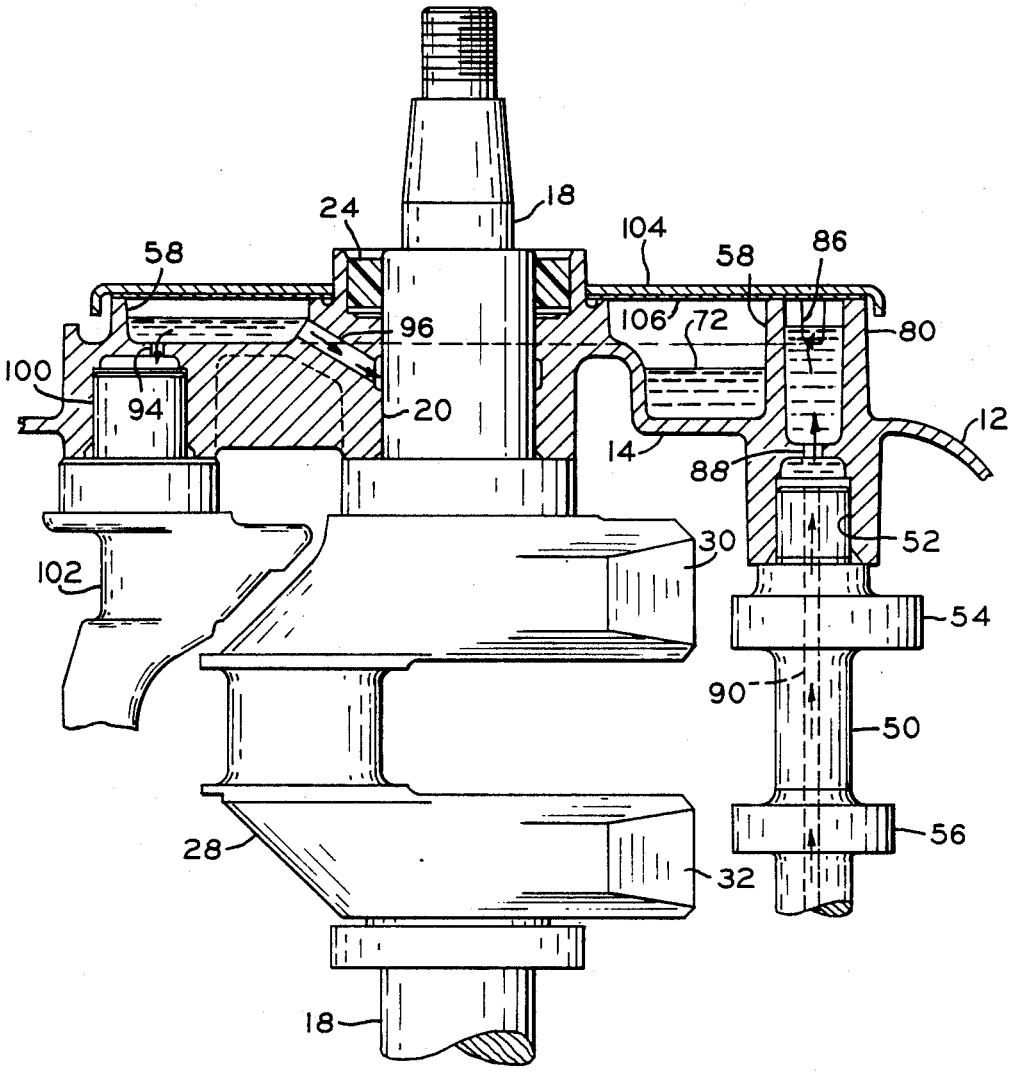
FIG. 3 is an elevational cross-sectional view of the engine of FIG. 1 taken along section line 3—3 of FIG. 4 and viewed in the direction of the arrows.

Referring particularly to FIG. 3 crankcase 12 includes vertically oriented camshaft 50 which is rotatably journalled in bearing journal 52. Camshaft 50 is connected in synchronous driven engagement with crankshaft 18 by conventional means not shown, and includes cam lobes 54 and 56 which engage the valve stems of the intake and exhaust valves (not shown) which are arranged in a side valve configuration. The present invention is also useful in combination with an overhead valve arrangement.

Figure 4:
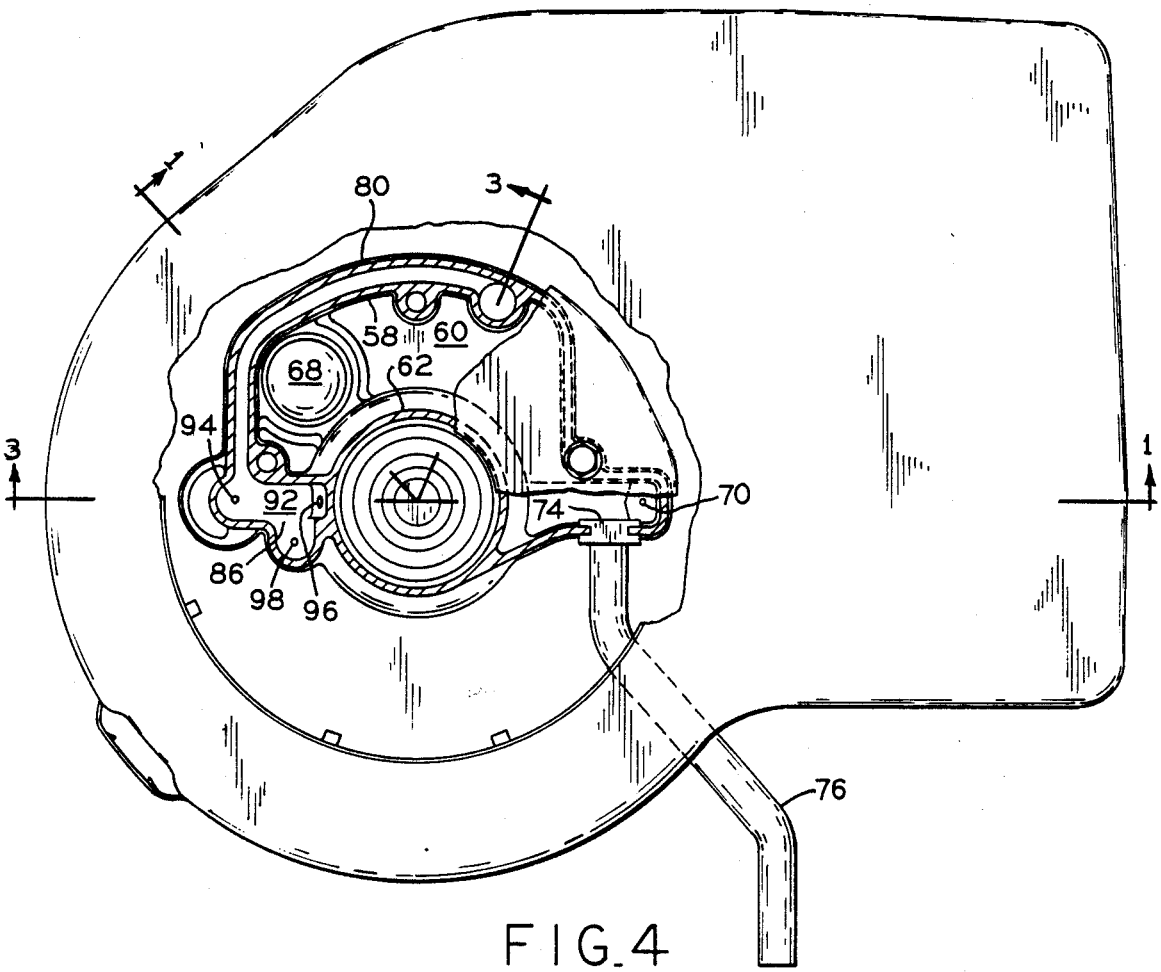
FIG. 4 is a partially cut away top view of the engine of FIG. 1.

Arranged on the top of top wall 14 and extending upwardly therefrom is an upstanding wall 58 which circumscribes and defines a breather chamber 60. Wall 58 is preferably cast integrally with top wall 14 which is likewise cast integrally with crankcase 12. Wall 58 includes a portion 62 (see FIG. 4) which lies circumjacent a portion of crankshaft 18 and forms the outer surface of upper bearing journal 20.

Disposed through top wall 14 is a breather passage 64 communicating the interior 66 of crankcase 12 with breather chamber 60. Passage 64 includes therein a breather check valve 68 which opens and permits flow of crankcase gases from crankcase interior 66 to breather chamber 60 when crankcase interior 66 is positively pressurized under the influence of piston 46 traversing its downstroke. Breather check valve 68 closes upon negative pressurization of crankcase interior 66 under the influence of piston 46 traversing its upstroke. Oil mist which is generated in crankcase interior 66 by splash lubrication and the slinging of oil from moving surfaces such as counterweights 30 and 32 of crankshaft 18 is incidentally carried by the crankcase gases through breather passage 64 and breather check valve 68 into breather chamber 60. The oil mist separates from the gases and settles out and collects in chamber 60, as indicated by oil pool 72 in FIGS. 1 and 3. The depth of oil pool 72 is exaggerated for clarity in the drawings. In actuality, the oil accumulates as only a thin film before being sucked back into the crankcase.

A drain passage 70 through the top side of the cylinder wall of cylinder 40 communicates breather chamber 60 with cylinder bore 34 and provides a pathway for liquid oil which has separated from the crankcase gases in breather chamber 60 to return to crankcase interior 66 via cylinder bore 34. Drain passage 70 is so located along the cylinder bore as to be within the stroke of piston 46, and thus be periodically occluded by the skirt of piston 46 as it reciprocates. In particular, drain passage 70 is located so as to be occluded by piston 46 during the end of travel on the downstroke and the beginning of travel on the upstroke thereof. Consequently, drain passage 70 becomes occluded as the pressure in crankcase interior 66 rises on the downstroke of piston 46, thereby preventing venting of crankcase gases into breather chamber 60 through drain hole 70. Likewise, drain passage 70 becomes uncovered as the pressure in crankcase interior 66 lowers on the upstroke of piston 46, thereby causing oil which has accumulated as oil pool 72 in breather chamber 60 to be sucked into cylinder bore 34 below piston 46 and thence returned into crankcase interior 66. Breather chamber 60 has a vent opening 74 (see FIG. 4) through which crankcase gases are vented either to the atmosphere or preferably through a conduit 76 to the intake of the combustion air induction system (not shown).

Breather passage 64 and drain hole 70 are generally centrally located with respect to the centerline of the engine defined by the cylinder bore and are in somewhat diametrically opposed spaced relationship to one another in the horizontal direction with respect to crankshaft 18. This has the advantage of permitting the engine to be tilted on its side for servicing as would be common where the engine is utilized to power a walk-behind lawn mower, without the crankcase oil draining out through the breather passage 64 when tilted on one side or out through the drain hole 70 when tilted on the other side. Thus the loss of oil out of breather chamber 60 through vent opening 74 is alleviated.

Figure 5:
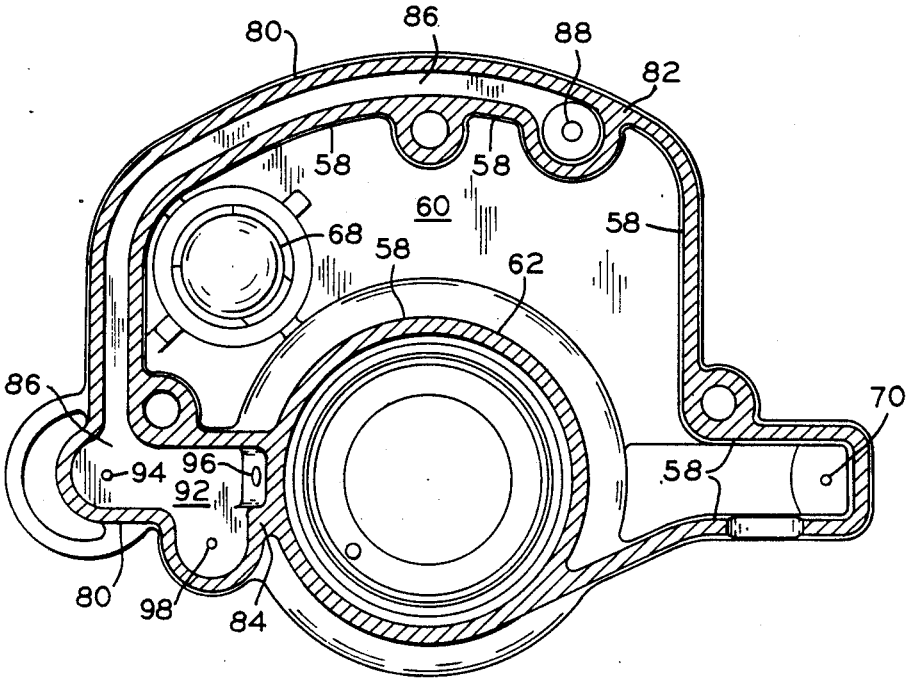
FIG. 5 is top view of a portion of the crankcase casting of the engine of FIG. 1, shown apart from the engine assembly.

Referring especially to FIGS. 1, 3 and 5, there is arranged on the top of top wall 14 and extending upwardly therefrom an upstanding wall 80 which is disposed in generally parallel spaced relationship to upstanding wall 58 along a portion of the outer periphery thereof away from crankshaft 18. Wall 80 joins wall 58 at points 82 and 84 and thereby defines an elongate curved lubrication chamber 86 lying adjacent to chamber 60 and traversing a portion of the periphery of chamber 60. Wall 80 is cast integrally with top wall 14 which is likewise cast integrally with crankcase 12. Communicating with lubrication chamber 86 at one end thereof is an oil entry passage 88 which communicates also with the top end of bearing journal 52 in which camshaft 50 is journalled. Camshaft 50 includes a longitudinal oil passageway 90 therethrough which communicates with oil entry passage 88 at the top end thereof and with the oil pump (not shown) at the bottom end thereof. Oil is introduced under pressure from the oil pump through oil passageway 90 of camshaft 50, thence through oil entry passage 88 into lubrication chamber 86.

At the opposite end of lubrication chamber 86 from oil entry passage 88, chamber 86 widens into an oil distribution chamber 92 having a plurality of oil distribution passageways communicating therewith such as oil ports 94, 96 and 98. Oil port 94 communicates with a bearing journal 100 in which is journalled a vertically oriented counterbalance shaft 102 for prevention of engine vibration. Counterbalance shaft 102 is in synchronous driven engagement with cranksahft 18 via conventional means not shown. Oil port 96 communicates with bearing journal 20 in which the upper end of crankshaft 18 is journalled to provide pressure lubrication of the crankshaft bearing journal. Oil port 98 provides oil spray directly into the interior 66 of crankcase 12 to lubricate the crank 28 of crankshaft 18.

It is a particular advantage of the arrangement of lubrication chamber 86 that oil can be transported about the top of the crankcase from a convenient oil riser such as the camshaft to whatever lubrication site requires direct lubrication without requiring the drilling and plugging of multiple cross passageways. Lubrication chamber 86 forms a sort of oil bus which can be tapped into by drilling a single straight passage through the bottom of chamber 86 to the lubrication site. Consequently, the cost of manufacturing the engine is significantly reduced. A further advantage with respect to cost of manufacture is obtained from the structural relationship described below.

Breather chamber 60 and lubrication chamber 86 are formed adjacent one another and defined by upstanding walls 58 and 80. As cast, the upstanding walls in combination with top wall 14 define open-topped channels which are easily die-cast without requiring special cores. The tops of walls 58 and 80 are machined to a common height defined by a horizontal plane. Consequently, both chambers 60 and 86 are closed at the top by a single removable cover plate 104 and corresponding sealing gasket 106.

While the present invention has been particularly described in the context of a preferred embodiment, it will be understood that the invention is not limited thereby. Therefore, it is intended that the scope of the invention include any variations, uses or adaptations of the invention following the general principles thereof and including such departures from the disclosed embodiments as come within known or customary practice in the art to which the invention pertains and which fall within the appended claims or the equivalents thereof.

What is claimed is:

1. In an internal combustion engine including a crankcase having a generally horizontally oiented top wall, an oil sump, an oil pump, and a vertically oriented crankshaft rotatably journalled therein, a horizontally oriented cylinder bore communicating with and extending from the crankcase, a piston disposed for reciprocation within the cylinder bore and linked to the crankshaft, and a plurality of lubrication sites, the improvement comprising:

a first upstanding wall extending upwardly from the top wall of said crankcase, said first upstanding wall circumscribing and defining a first chamber;

breather passage means for communicating crankcase gases from said crankcase into said first chamber;

drain passage means for communicating oil separated from the crankcase gases in said first chamber into the cylinder bore below the piston, said drain passage means being positioned along the cylinder bore so as to be periodically occluded by the piston during reciprocation thereof;

a second upstanding wall extending upwardly from the top wall of said crankcase in spaced relationship to at least a portion of said first wall, said first and second walls defining therebetween a second chamber;

first oil passage means communicating oil from said lubricant pump to said second chamber; and second oil passage means communicating oil from said second chamber to at least one of the lubrication sites.

2. The engine of claim 1, in which said first chamber is closed by a top cover removably attached to said first upstanding wall.

3. The engine of claim 1, in which said second chamber is closed by a top cover removably attached to said second upstanding wall.

4. The engine of claim 1, in which said first and second chambers are closed by a common top cover removably attached to both of said first and second upstanding walls.

5. The engine of claim 4, in which said first and second walls are finished to a common height and closed by a planar top cover.

6. An internal combustion engine comprising:

a crankcase;

a vertically oriented crankcase rotatably journalled in said crankcase;

a piston linked to sad crankshaft and mounted for reciprocation in an cylinder;

a plurality of lubrication sites in said crankcase;

a first upstanding wall extending upwardly from said crankcase, said first upstanding wall circumscribing defining a first chamber;

breather passage means for communicating crankcase gases from said crankcase into said first chamber;

drain passage means for communicating oil separated from the crankcase gases in said first chamber back into said crankcase;

a second upstanding wall extending upwardly from said crankcase in spaced relationship to at least a portion of said first wall, said first and second walls defining therebetween a second chamber;

first oil passage means communicating oil under pressure to said second chamber; and second oil passage means communicating oil from said second chamber to at least one of the lubrication sites.

7. The engine of claim 6, in which said first chamber is closed by a top cover.

8. The engine of claim 6, in which said second chamber is closed by a top cover.

9. The engine of claim 6, in which said first and second chambers are closed by a common to cover.

10. The engine of claim 9, in which said first and second walls are finished to a common height and closed by a planar top cover.

11. The engine of claim 6, in which said drain passage means is ported by the piston so as to be periodically occluded as the piston reciprocates.

12. An internal combustion engine comprising:

a crankcase;

a vertically oriented crankshaft rotatably journalled in said crankcase;

a plurality of lubrication sites in said crankcase;

an upstanding wall integral with said crankcase and extending upwardly therefrom, said upstanding wall circumscribing and defining a lubrication chamber having an open top;

closure means removably attached to said upstanding walls for closing the open-top of said chamber;

first oil passage means communicating oil under pressure to said chamber; and second oil passage means communicating oil from said chamber to at least one of the lubrication sites.

13. The engine of claim 12, in which said chamber is elongated and extends substantially horizontally.

14. The engine of claim 12, in which said first oil passage means communicates with a hollow rotating shaft disposed in said engine, said hollow rotating shaft communicating oil to said first oil passage means.

15. The engine of claim 12, in which said second oil passage means is straight between said chamber and said lubrication site.

16. The engine of claim 13, in which said closure means includes a cover engaging said upstanding wall in a common plane.

* * * * *